US009741270B2

(12) United States Patent
Zaccai et al.

(10) Patent No.: US 9,741,270 B2
(45) Date of Patent: Aug. 22, 2017

(54) DISPLAY BOARD SYSTEM

(71) Applicant: Herman Miller, Inc., Zeeland, MI (US)

(72) Inventors: Gianfranco Zaccai, Needham, MA (US); Mark Bates, Westwood, MA (US); Alexander Broerman, Boston, MA (US); Kyle Madison, Grand Haven, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 15/090,121

(22) Filed: Apr. 4, 2016

(65) Prior Publication Data

US 2016/0293067 A1 Oct. 6, 2016

Related U.S. Application Data

(60) Provisional application No. 62/142,178, filed on Apr. 2, 2015.

(51) Int. Cl.

| | |
|---|---|
| ***G09F 7/20*** | (2006.01) |
| ***G09F 15/00*** | (2006.01) |
| *G09F 7/18* | (2006.01) |

(52) U.S. Cl.

CPC ..... *G09F 7/20* (2013.01); *G09F 15/0018* (2013.01); *G09F 15/0056* (2013.01); *G09F 2007/1847* (2013.01); *G09F 2007/1856* (2013.01)

(58) Field of Classification Search

CPC .... G09F 7/20; G09F 15/0018; G09F 15/0056; G09F 2007/1847

See application file for complete search history.

(56) References Cited

U.S. PATENT DOCUMENTS

| | | | | |
|---|---|---|---|---|
| 3,914,824 | A | 10/1975 | Purdy | |
| 3,947,138 | A | 3/1976 | Eshelman | |
| 4,521,035 | A * | 6/1985 | Berezowsky | B42F 1/00 24/555 |
| 5,899,332 | A | 5/1999 | Breton et al. | |
| 6,272,779 | B1 * | 8/2001 | Seiber | G09F 7/18 248/453 |
| 6,854,202 | B1 * | 2/2005 | Ives | G09F 15/0087 40/491 |

(Continued)

OTHER PUBLICATIONS

"Huddleboard Steelcase Premium Whiteboard" brochure, item #08-0001216 dated Oct. 2008 (4 pages).

(Continued)

*Primary Examiner* — Gary C Hoge

(74) *Attorney, Agent, or Firm* — Michael Best & Friedrich LLP

(57) ABSTRACT

A display board system includes a first display board, a second display board, a first clip, and a second clip. The first clip is coupled to the first display board and includes a body and a top portion coupled to the body generally above an upper edge of the first display board. The top portion has an upwardly facing cavity and a downwardly extending tab. The second clip is coupled to the second display board and includes a body and a top portion coupled to the body generally above an upper edge of the second display board. The top portion has an upwardly facing cavity and a downwardly extending tab. The tab of the second clip is receivable in the cavity of the first clip to support the second display board on the first display board.

20 Claims, 11 Drawing Sheets

(56) References Cited

U.S. PATENT DOCUMENTS

| | | | | |
|---|---|---|---|---|
| 7,325,343 | B2 | 2/2008 | Seiber et al. | |
| 2005/0191611 | A1 | 9/2005 | Owen et al. | |
| 2015/0243194 | A1* | 8/2015 | Schmidt | G09F 7/20 434/408 |

OTHER PUBLICATIONS

"Steelcase Verb Whiteboard" brochure, item #15-0000869 dated Jul. 2015 (11 pages).
"EganSystem Track Solutions" brochure, dated 2015 (11 pages).
International Search Report for Application No. PCT/US2016/025866 dated Jul. 20, 2016 (3 pages).
International Written Opinion for Application No. PCT/US2016/025866 dated Jul. 20, 2016 (8 pages).

* cited by examiner

DISPLAY BOARD SYSTEM

CROSS-REFERENCE TO RELATED APPLICATIONS

This application claims priority to U.S. Provisional Patent Application No. 62/142,178 filed Apr. 2, 2015, the entire contents of which are incorporated by reference herein.

BACKGROUND

The present invention relates to a system of stackable display boards.

Display boards are typically independently supported, for instance by a stand or by hangers, and the display boards are not stackable. When a support rail is used to support one or more display boards, the rail independently supports each board and cannot accommodate more than two boards. Therefore, the arrangement of a plurality of display boards on the stand, the hangers or the support rail may be limited. For example, the display boards may not be rearrangable from an overlying configuration to a side-by-side configuration or from a side-by-side configuration to an overlying configuration.

SUMMARY

In one embodiment, the invention provides a display board system including a first display board having a front, a back, an upper edge, and a lower edge. The display board system also includes a second display board having a front, a back, an upper edge, and a lower edge. The display board system further includes a first clip coupled to the first display board proximate the upper edge. The first clip includes a body extending along a section of the back of the first display board and a top portion coupled to the body generally above the upper edge of the first display board. The top portion has an upwardly facing cavity and a downwardly extending tab. The cavity is closer than the tab to the front of the first display board. The display board system also includes a second clip coupled to the second display board proximate the upper edge. The second clip includes a body extending along a section of the back of the second display board and a top portion coupled to the body generally above the upper edge of the second display board. The top portion has an upwardly facing cavity and a downwardly extending tab. The cavity is closer than the tab to the front of the second display board. The tab of the second clip is receivable in the cavity of the first clip to support the second display board on the first display board.

In another embodiment, the invention provides a clip for a display board having a front, a back, an upper edge, and a lower edge. The clip includes a body configured to extend along a section of the back of the display board. The body is a generally planar member defining a central plane. The clip also includes a top portion coupled to body and configured to be positioned generally above the upper edge of the display board. The top portion has an upwardly facing cavity and a downwardly extending tab. The cavity is located on one side of the central plane so that the cavity is configured to be aligned with the upper edge of the display board generally between the front and the back of the display board. The tab is located on an opposite side of the central plane so that the tab is configured to be spaced further than the body from the back of the display board.

In yet another embodiment, the invention provides a display board system including a display board having a front, a back, an upper edge, and a lower edge. The display board system also includes a clip coupled to the display board proximate the upper edge. The clip includes a body extending along a section of the back and a top portion coupled to the body generally above the upper edge of the display board. The top portion has an upwardly facing cavity and a downwardly extending tab. The cavity is closer than the tab to the front of the display board. The display board system further includes a support rail having an upwardly extending channel. The upwardly extending channel receives the tab of the clip to support the display board on the rail.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
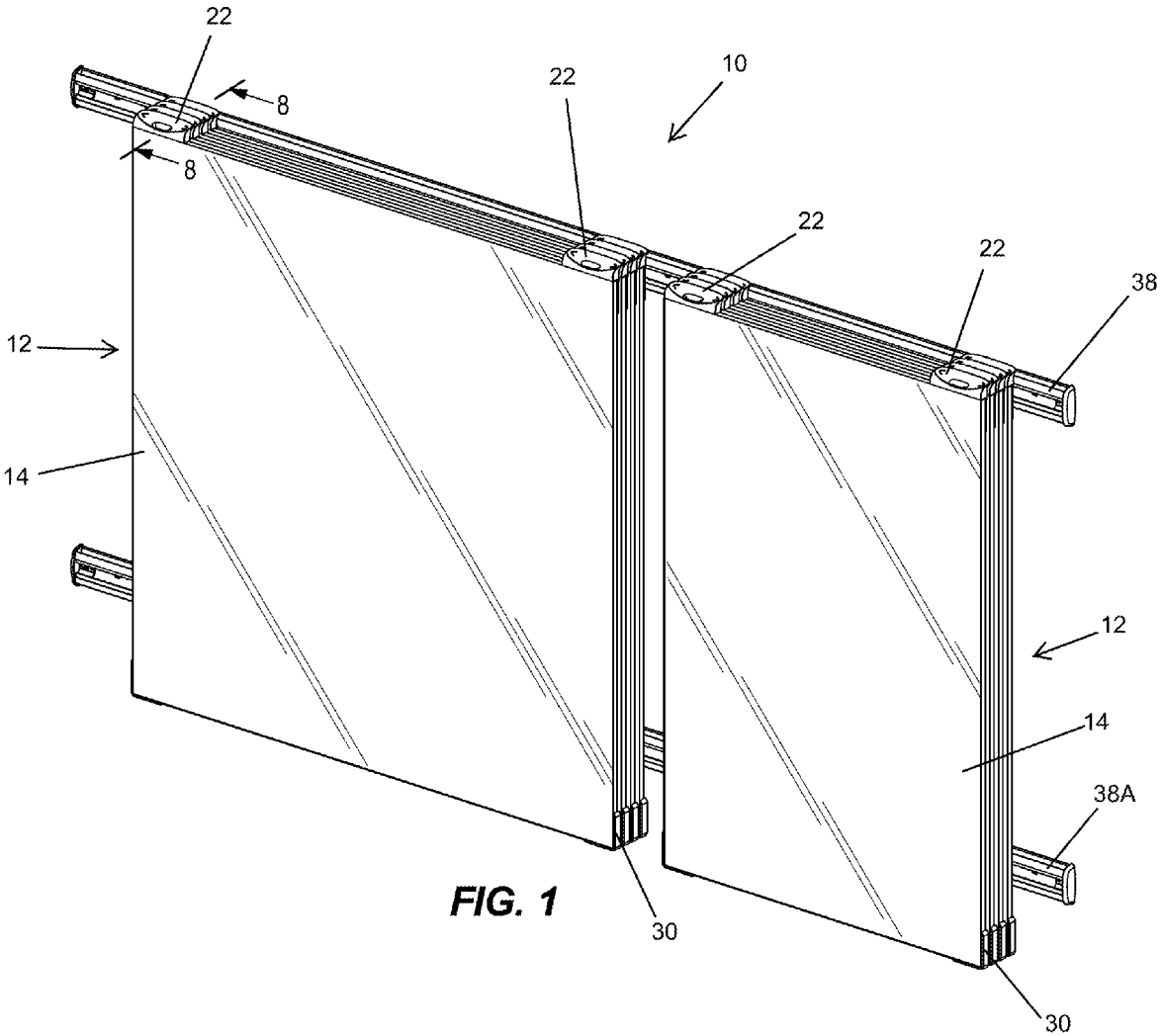
FIG. 1 is a front perspective view of a display board system according to one embodiment of the invention.
Figure 2:
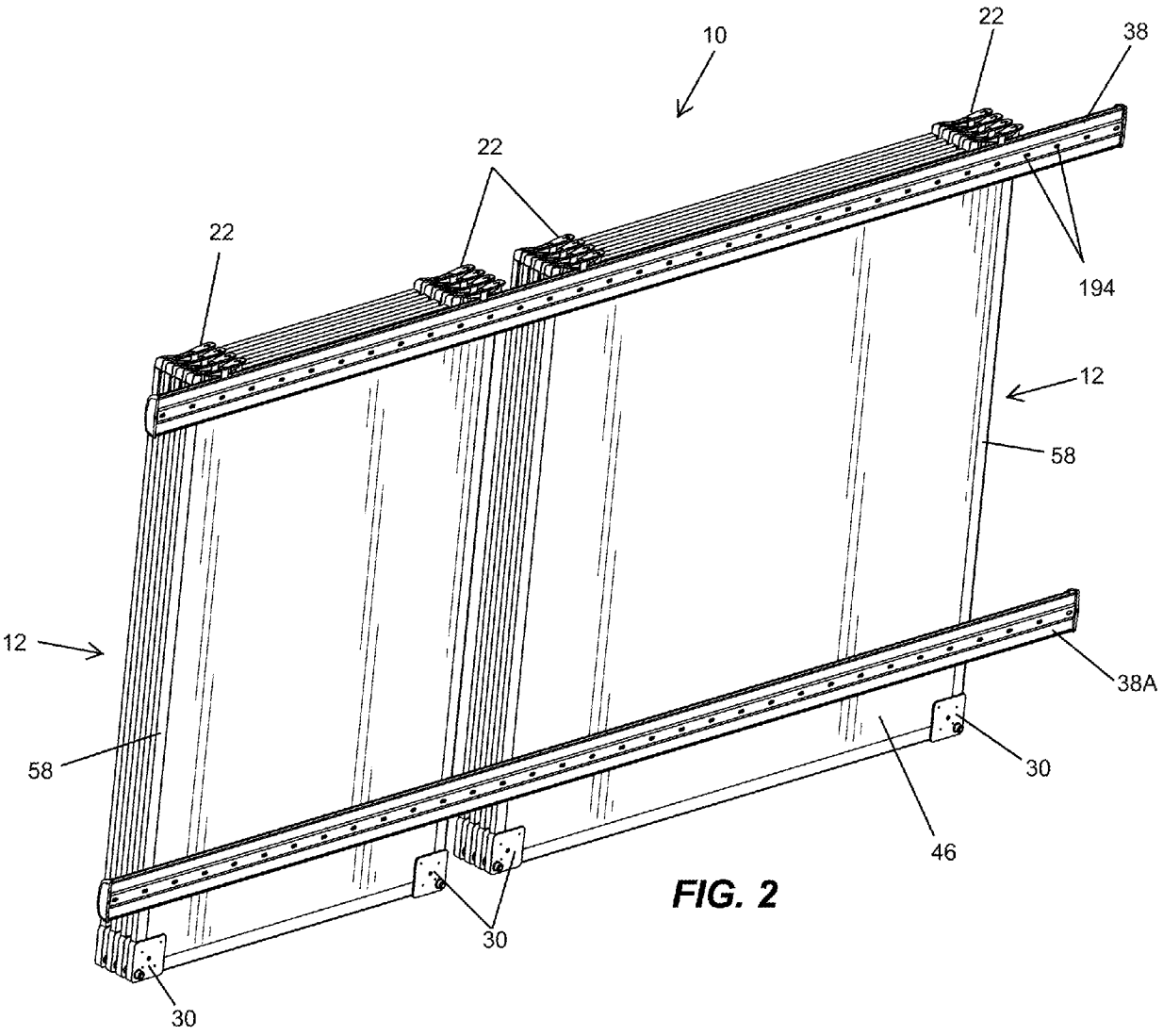
FIG. 2 is a rear perspective view of the display board system of FIG. 1.
Figure 3:
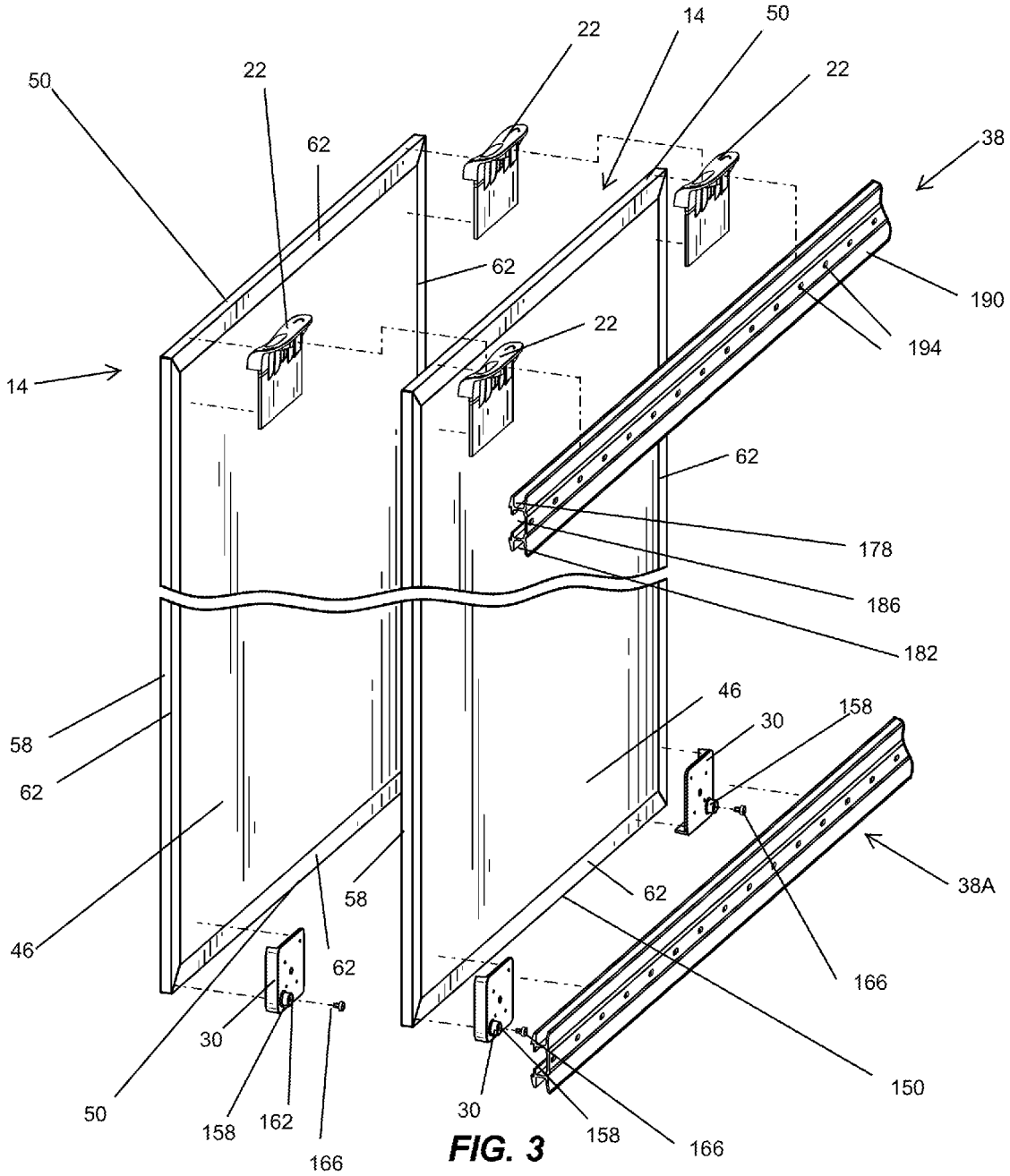
FIG. 3 is an exploded perspective view of a portion of the display board system of FIG. 1.

FIGS. 1-3 illustrate a display board system 10 embodying the invention. The illustrated display board system 10 is configured to allow a plurality of display board assemblies 12 to be stacked one on top of the other. In the illustrated embodiment, the system 10 includes eight display board assemblies 12 grouped in two stacks of four, but may alternatively include fewer or more assemblies 12. The display board system 10 may be installed in, for example, a conference room, presentation room, school, hospital, or other facility to facilitate discussions. The plurality of display board assemblies 12 of the illustrated system 10 may also be rearrangeable from a stacked configuration to a side-by-side configuration on a support rail 38. The support rail 38 may be attached to a wall or other vertical support structure. Alternatively, the support rail 38 may be attached to a cart 200, 300, as shown in FIGS. 10-13.

As noted above, the illustrated system 10 shown in FIGS. 1 and 2 includes eight display board assemblies 12. Each display board assembly 12 is substantially similar, with only the size/dimensions of the two stacks of assemblies 12 differing. As such, only one of the display board assemblies 12 is described in detail below, and like reference numbers will be used to refer to like parts on the display board assemblies 12.

With reference to FIG. 3, the display board assembly 12 includes a display board 14, two clips 22, and two spacers 30. The display board 14 includes a front 42, a back 46, an upper edge 50, a lower edge 54, and two side edges 58. The front 42 and the back 46 of the display board 14 are defined by generally planar surfaces. The illustrated edges 50, 54, 58 are defined by frame members 62 that surround the planar surface of the back 46. In other embodiments, the frame members 62 may be omitted, and the edges 50, 54, 58 may be defined by edges of the planar surfaces. The front 42 of the display board 14 includes a user-interactive surface, such as, for example, a white board, tack board, or a pad of chart paper. In the illustrated embodiment, the display board 14 is generally rectangular in shape with straight edges. In alternate embodiments, the display board 14 may have other shapes and configurations, such as curved, rounded, or other non-linear edges.

The clips 22 are coupled to the display board 14 adjacent the upper edge 50. In some embodiments, the clips 22 may be secured to the display board 14 with fasteners (e.g., screws, rivets, nails, etc.) and/or adhesives (e.g., glue, double-sided tape, etc.). The clips 22 are substantially identical, and only one clip 22 is described in detail below. Although each of the illustrated display board assemblies 12 includes two clips 22, in some embodiments each display board assembly 12 may include one clip 22, three clips 22, or more clips 22 (depending on the size of the display board 14).

As shown in FIGS. 4-7, each clip 22 includes a substantially planar body 82, a top portion 102 with an upwardly facing cavity 106 and a downwardly extending tab 110, and a cap 140. The substantially planar body 82 has a front surface 90 and a back surface 94. The front surface 90, or first surface, faces toward the display board 14. The back surface 94, or second surface, faces away from the display board 14. The substantially planar body 82 also defines a central plane 86 between the front and back surfaces 90, 94. In some embodiments, the planar body 82 includes apertures 98 (FIG. 11) formed through the surfaces 90, 94 to help locate and receive fasteners that secure the clip 22 to the display board 14.

Figure 6:
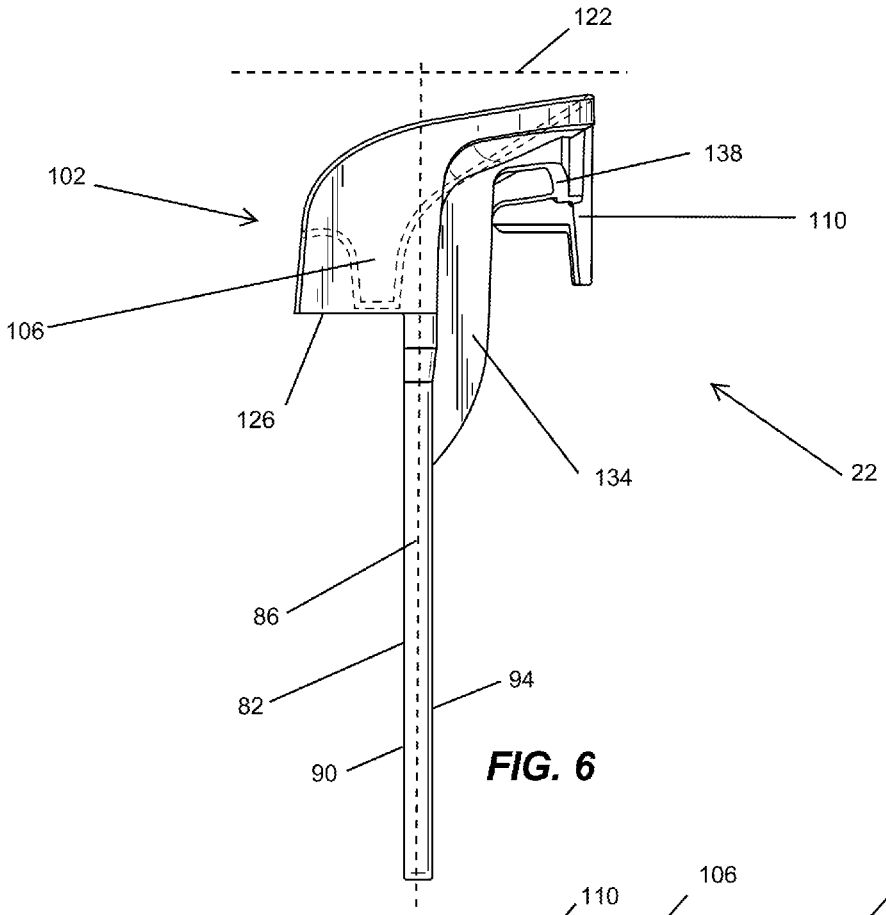
FIG. 6 is a side view of the clip of FIG. 4.
Figure 7:
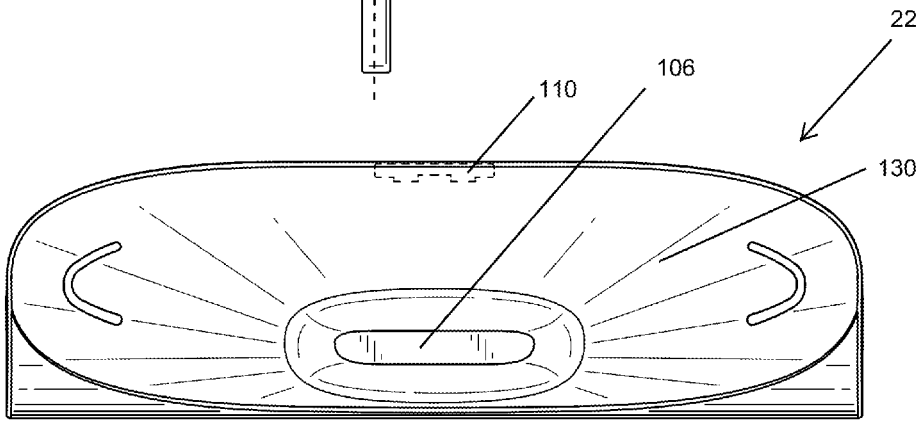
FIG. 7 is a top view of the clip of FIG. 4.

The top portion 102 is coupled to the substantially planar body 82. In the illustrated embodiment, the top portion 102 and the planar body 82 are integrally formed (e.g., molded) as a single piece. In other embodiments, the top portion 102 and the planar body 82 may be separate pieces that are secured together. The top portion 102 includes the upwardly facing cavity 106 and the downwardly extending tab 110. As shown in FIG. 6, the upwardly facing cavity 106 is located on a first side of the central plane 86. The downwardly extending tab 110 is located on a second side of the central plane 86 opposite from the cavity 106. The cavity 106 and the tab 110 are both spaced from the substantially planar body 82. As shown in FIG. 7, when viewed along the central plane 86 (i.e., when viewed in a direction perpendicular to a plane 112 that is perpendicular to the central plane 86), the upwardly facing cavity 106 has a first cross sectional shape, and the downwardly extending tab 110 has a second cross-sectional shape. The second cross-sectional shape is sized to fit within the first cross-sectional shape such that the tab 110 could fit snugly within the cavity 106.

As shown in FIG. 6, the top portion 102 proximate the upwardly facing cavity 106 has a substantially flat bottom 126. The substantially flat bottom 126 is generally perpendicular to the front surface 90 of the substantially planar body 82. The shape of the substantially flat bottom 126 allows the clip 22 to sit flush on the upper edge 70 of the display board 14.

The top portion 102 also includes an upper surface 130 surrounding the upwardly facing cavity 106. The illustrated upper surface 130 is a sloped upper surface. More particularly, the sloped upper surface 130 is concave when viewed from above. In some embodiments, the sloped upper surface is 130 configured to be a grippable handle. In the illustrated embodiment, the cavity 106 is a depression formed in the top portion 102, and a section of the clip 22 forms a bottom wall of the cavity 106. In other embodiments, the upwardly facing cavity 106 may be a through-opening formed in the top portion 102.

Figure 5:
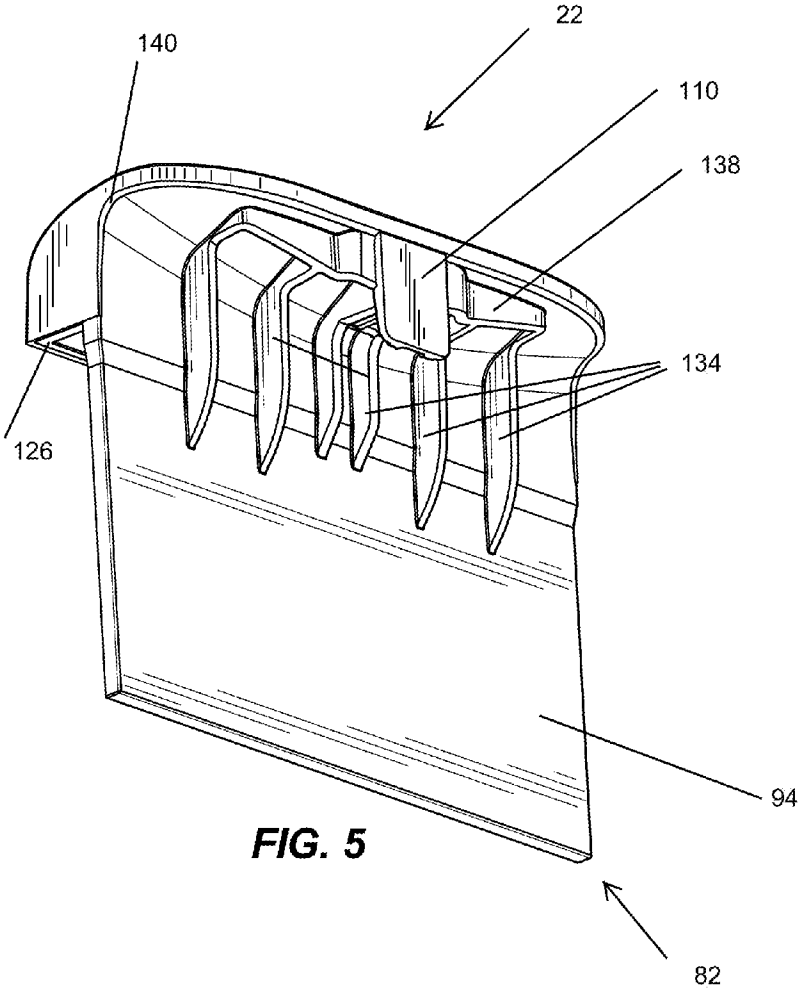
FIG. 5 is a rear perspective view of the clip of FIG. 4.
Figure 4:
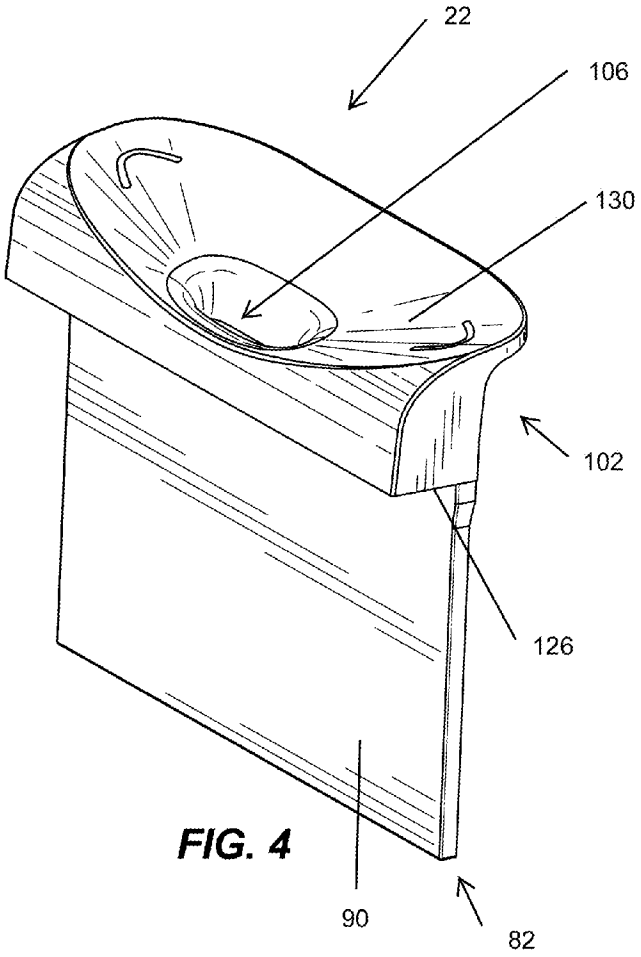
FIG. 4 is a front perspective view of a clip of the display board system of FIG. 1.

With reference to FIG. 5, the clip 22 includes a plurality of ribs 134 formed on the back surface 94 of the substantially planar body 82 and a lower surface of the top portion 102. The ribs 134 extend rearwardly (i.e., away from the display board 14) from the back surface 94 of the substantially planar body 82. The ribs 134 also extend downwardly from the top portion 102 proximate the downwardly extending tab 110. The ribs 134 are configured to maintain spacing between the clip 22 and an adjacent display board assembly 12. The ribs 134 form a downwardly extending support structure 138 proximate the downwardly extending tab 110. The downwardly extending support structure 138 has a profile substantially similar to the sloped upper surface 130.

The cap 140 is coupled to the top portion 102 of the clip 22. The cap 140 substantially covers the top portion 102 to give the top portion 102 a finished appearance. The shape of the cap 140 is substantially the same as the shape of the top portion 102 of the first clip 22. In one embodiment, the clip 22 may be made in a two-shot injection molded process, with the planar body 82 and the top portion 102 made of a hard durometer plastic, and the cap 140 made of a softer durometer plastic. In such embodiments, the cap 140 provides a softer touch and reduces noise levels associated with a plurality clips 22 interfacing with each other or with the rail 38.

Figure 8:
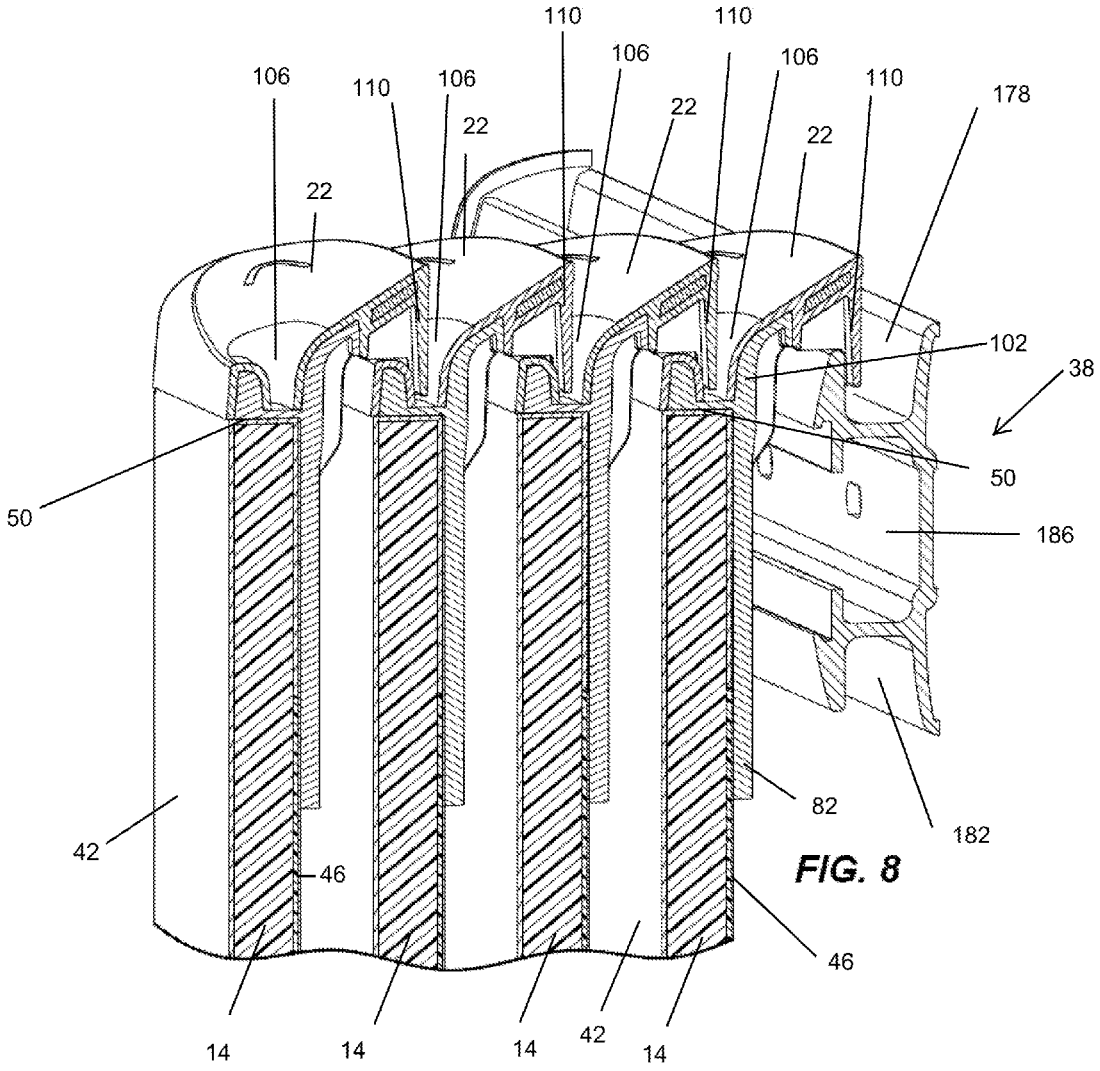
FIG. 8 is a cross-sectional view taken along section line 8-8 of the display board system of FIG. 1.

FIG. 8 illustrates four clips 22 attached to corresponding display boards 14. The planar body 82 of each clip 22 extends along a section of the back 46 of the corresponding display board 14. The top portion 102 of each clip 22 is positioned above the upper edge 46 of the corresponding display board 14. The substantially flat bottom 126 of the top portion 102 is adjacent to and sits flush with the upper edge 50 of the corresponding display board 14. The upwardly facing cavity 106 is generally aligned with the upper edge 70 of the corresponding display board 14 generally between the front 42 and the back 46 of the display board 14. The downwardly extending tab 110 is spaced farther than the substantially planar body 82 from the back 46 of the corresponding display board 14. In addition, the upwardly facing cavity 106 is closer than the downwardly extending tab 110 to the front 42 of the corresponding display board 14. The tab 110 of each clip 22, thereby, creates an outwardly-projecting connector that can be received in the cavity 106 of an adjacent clip 22 or on the support rail 38 to stack and support the display board assemblies 12, as further described below.

Referring back to FIGS. 2 and 3, the spacers 30 are coupled to the display board 14 adjacent the lower edge 54. In some embodiments, the spacers 30 may be secured to the display board 14 with fasteners (e.g., screws, rivets, nails, etc.) and/or adhesives (e.g., glue, double-sided tape, etc.). The spacers 30 are substantially identical, and only one spacer 30 is described in detail below. Although each of the illustrated display board assemblies 12 includes two spacers 30 located at lower corners of the boards 14, in some embodiments each display board assembly 12 may include one spacer 30, three spacers 30, or more spacers 30. Additionally or alternatively, the spacers 30 may be located elsewhere on the display boards 12.

Figure 9:
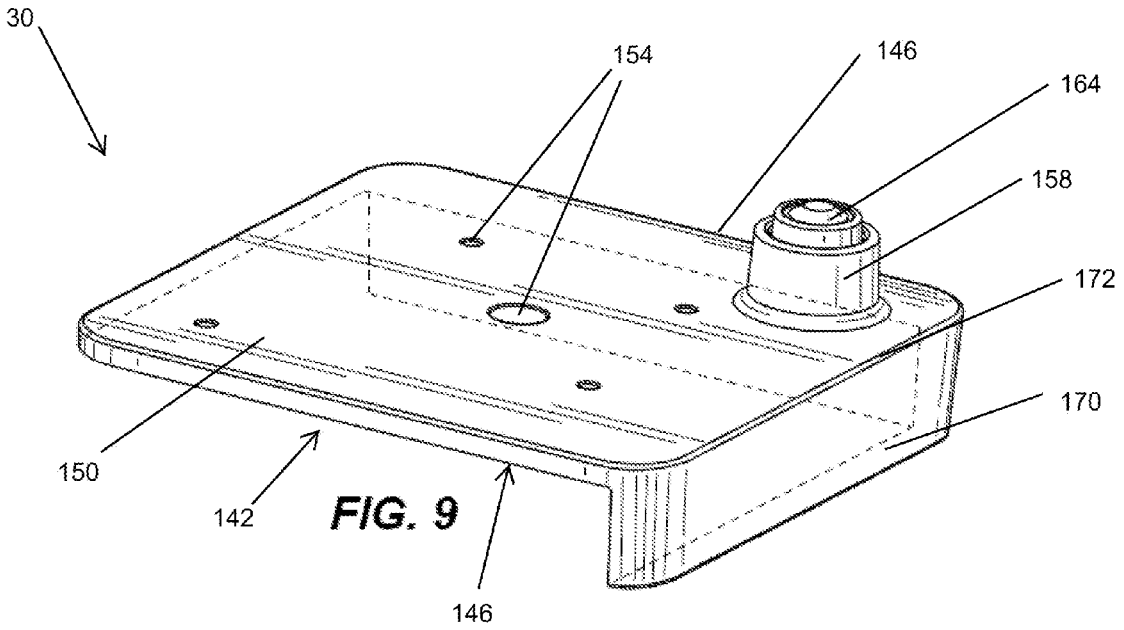
FIG. 9 is a perspective view of a spacer of the display board system of FIG. 1.

As shown in FIG. 9, the spacer 30 includes a substantially planar body 142, a sidewall 170, and a boss 158. The substantially planar body 142 has a front 146, a back 150, and a plurality of apertures 154. The body 142 is configured to sit against the back 46 of the display board 14. The apertures 154 are formed through the front 146 and the back 150 to help locate and receive fasteners that secure the spacer 30 to the display board 14.

The sidewall 170 extends from the body 142 and is configured to wrap around edges of the display board 14. In particular, the sidewall 170 wraps around a portion of the lower edge 50 of the display board 14 and around a portion of one of the side edges 58 of the display board 14. The sidewall 170 helps locate and secure the spacer 30 on the display board 14. The sidewall 170 also provides a corner cover member or bumper that helps protect the display board 14 if, for example, the display board assembly 12 contacts the ground.

The boss 158 extends from the back 150 of the planar body 142 away from the display board 14. The boss 158 has a central bore 162 (FIG. 3). A plug 166 is disposed in the central bore 162 of the boss 158. The plug 166 may be formed of a resiliently deformable material, such as rubber. The plug 166 is configured to contact an adjacent display board 14 or a wall to maintain spacing between the display board 14 and either the adjacent display board 14 or the wall. The plug 166 also inhibits the display board 14 from marring the adjacent display board 14 or the wall.

Referring back to FIGS. 2 and 3, the spacers 30 are attached to the display board 14. The planar bodies 82 extend along the back 46 of the display board 14. The sidewalls 170 wrap around the lower edge 54 and the side edges 58 of the display board 14. The bosses 158 with the plugs 166 extend rearwardly from the spacer 30 so that the display boards 14 hang substantially parallel to a wall or other vertical support structure.

With reference to FIG. 8, the display board assemblies 12 can be stacked on top of each other to support multiple display board assemblies 12 on the support rail 38. The downwardly extending tab 110 of the clip 22 of one (i.e., a second) display board assembly 12 is receivable in the upwardly facing cavity 106 of the clip 22 of an adjacent (i.e., a first) display board assembly 12. The downwardly extending support structure 138 of the clip 22 of the second display board assembly 12 engages the sloped upper surface 130 of the clip 22 of the first display board assembly 12 to maintain spacing between the second display board 14 and the first display board 14. The downwardly extending support structure 138 of the second clip 22 of the second display board assembly 12 also supports a portion of the weight of the second display board 14A. In this stacked configuration, the back 46 of the second display board 14 is proximate the front 42 of the first display board 14. As shown in FIG. 2, the rearwardly extending boss 158 of the spacer 30 of the second display board assembly 12 ensures adequate spacing between the back 46 of the second display board 14 and the front 42 of the first display board 14. This spacing prevents the back 46 of the second display board 14 from touching objects extending from the front 42 surface (e.g., tacked or hung onto) of the first display board 14. In this manner, the second display board assembly 12 can be stacked on top of the first display board assembly 12.

Similarly, a third display board assembly 12 can be stacked over the second display board assembly 12 by positioning the downwardly extending tab 110 of the clip 22 of the third display board assembly 12 within the upwardly facing cavity 106 of the clip 22 of the second display board assembly 12. A fourth display board assembly 12 can be stacked over the third display board assembly 12 by positioning the downwardly extending tab 110 of the clip 22 of the fourth display board assembly within the upwardly extending cavity 106 of the clip 22 of the third display board assembly.

With continued reference to FIG. 8, the support rail 38 includes an upwardly extending channel 178, a downwardly extending channel 182, an interior channel 186, and a rear surface 190. The upwardly extending channel 178 extends along a length of the support rail 38. The upwardly extending channel 178 is configured to slidably receive the downwardly extending tabs 110 of the clips 22. The interior channel 186 extends along the length of the support rail 38. The interior channel 186 may be configured to provide a raceway for various utilities, for example, electric lines or cables. A rear surface 190 of the support rail 38 includes a plurality of apertures 194. The apertures 194 may accommodate fasteners to attach the support rail to a wall, a cart 200, 300 (FIGS. 10-13), or other support structures. The fasteners may be, for example nails, screws, adhesives, and other known connectors.

The downwardly extending tabs 110 of the clip 22*s* are slidingly receivable in the upwardly extending channel 178 of the support rail 38. As such, the clips 22 (and thereby the corresponding display boards 14) can be slid along the support rail 38 to different positions without having to remove the clips 22 from the support rail 38. In the embodiment shown in FIGS. 1-2, a second support rail 38A is positioned below and spaced from the support rail 38. The illustrated second support rail 38A is constructed similar to the support rail 38. When the support rail 38 is attached to the wall, the second support rail 38A contacts the back 46 of the display board 14 to ensure adequate spacing between the display board 14 and the wall. In such embodiments, the spacers 30 are positioned proximate the second support rail 38A, but do not engage the second support rail 38A or the wall. In other embodiments, the spacers 30 may engage the second support rail 38A or the wall, and/or the second support rail 38A may be omitted. When the support rail 38 is attached to the cart 200, 300 (where a second rail is not present), the rearwardly extending bosses 158 of the spacers 30 ensure adequate spacing between the back 46 of the display board 14 and the cart 200, 300.

In operation, a user may draw, pin, or otherwise use the outermost display board assembly 12, for example to brainstorm, give a presentation, or watch a display (projected or on a monitor). The user may then remove the outermost display board assembly 12 to another position, such as along the upwardly extending channel 178 of the support rail 38 or stacked on top of another display board assembly. This will display the next display board assembly 12 for user interaction while preserving the work or operations performed on the outermost display board assembly 12. In this way, the display board assemblies 12 can be easily moved back and forth from a stacked configuration to a side-by-side configuration.

Figure 10:
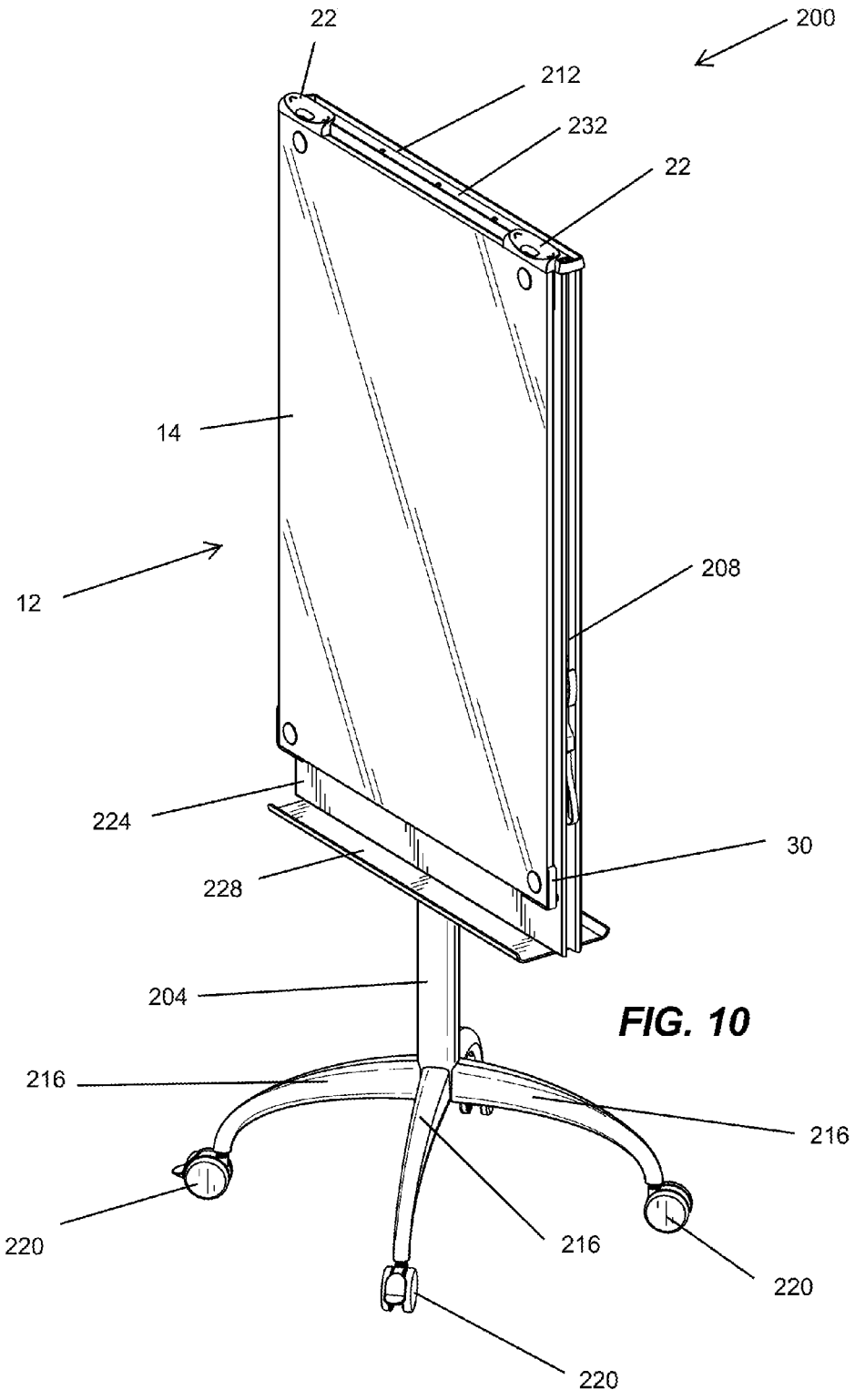
FIG. 10 is a front perspective view of a display board system on a cart.
Figure 11:
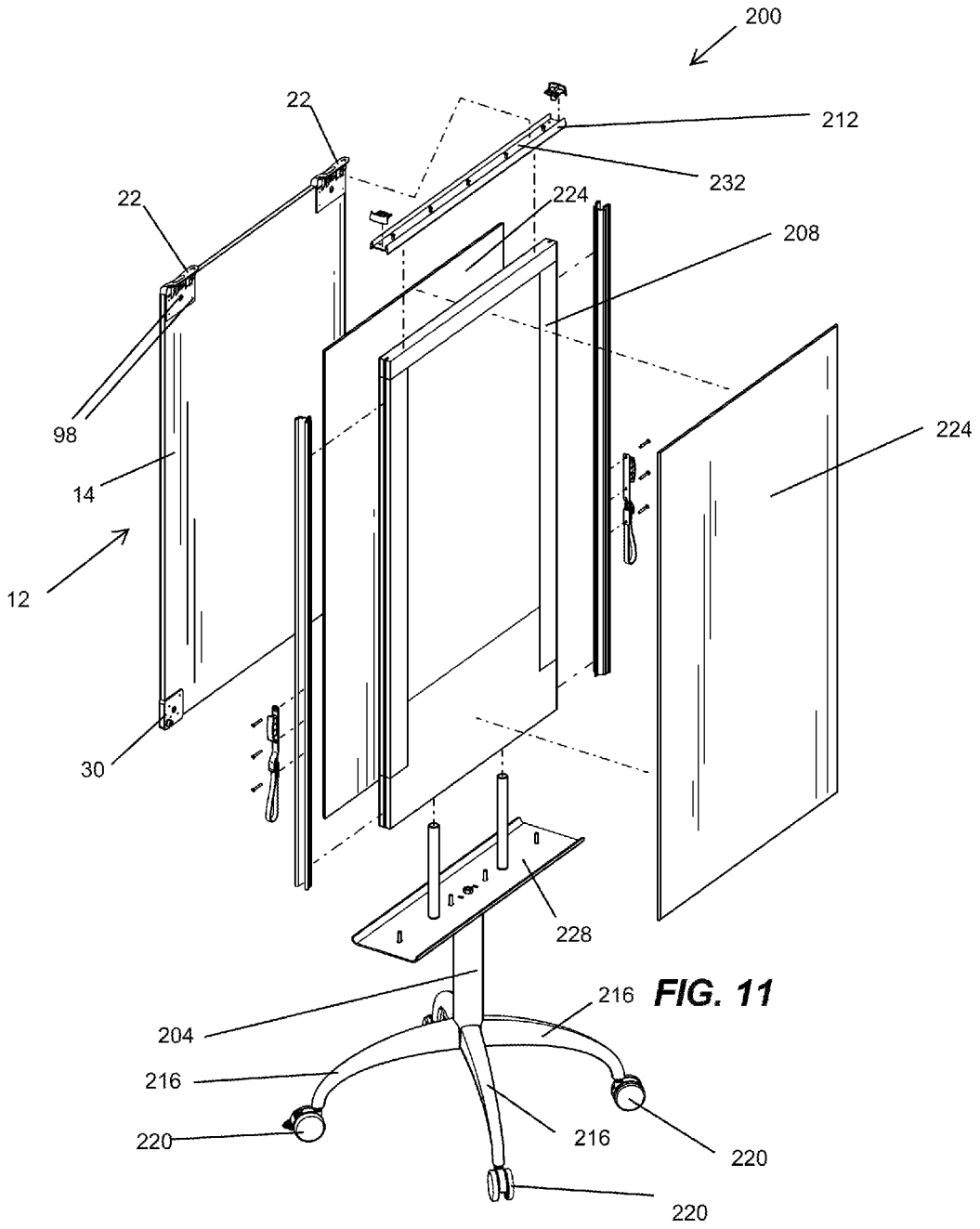
FIG. 11 is an exploded perspective view of the display board system and the cart of FIG. 10.

FIGS. 10 and 11 illustrate the first cart 200 configured to support one or more display board assemblies 12 (only one display board assembly 12 is shown in the drawings). The first cart 200 includes a base 204, a support structure 208, and a support rail 212. The illustrated base 204 includes four legs 216 arranged in an X-shaped configuration and caster wheels 220 attached to ends of the legs 216. The support structure 208 is coupled to and supported by the base 204. The support structure 208 includes center panels 224 and a tray 228. The illustrated center panels 224 are generally the same size (e.g., width) as the display board assembly 12. The tray 228 is positioned beneath the center panels 224 and is configured to store accessories (e.g., markers, pens, erasers, etc.) associated with the cart 200 and the display board assembly 12. The support rail 212 is coupled to an upper edge of the center panels 224. Similar to the support rail 38 described above, the illustrated support rail 212 includes an upwardly extending channel 232 that receives the tabs 110 of the clips 22 to support the display board assemblies 12 on the cart 200. The cart 200 can, therefore, be used to movably support a single display board assembly 12 or a plurality of stacked display board assemblies 12.

Figure 12:
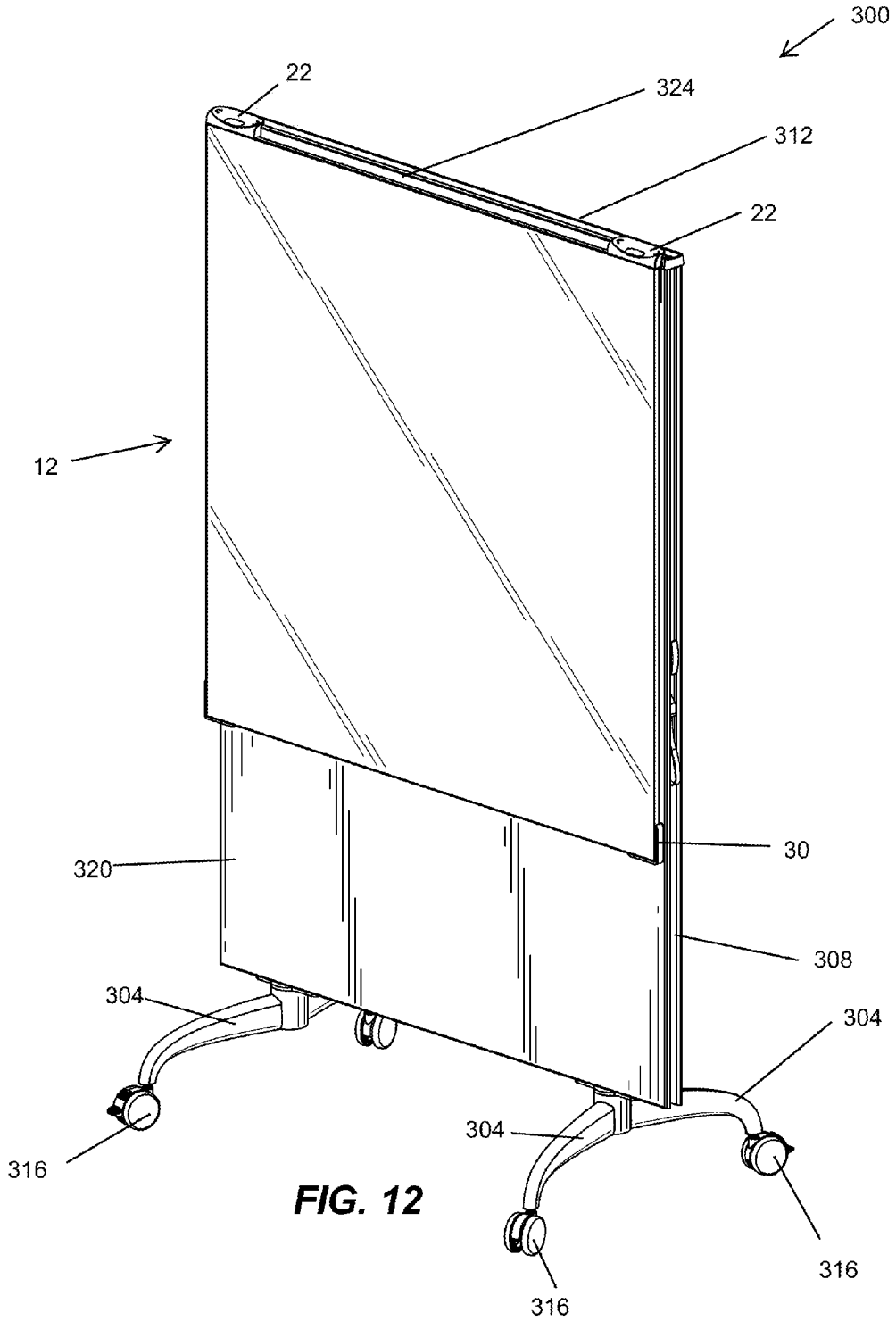
FIG. 12 is a front perspective view of a display board system on another cart.
Figure 13:
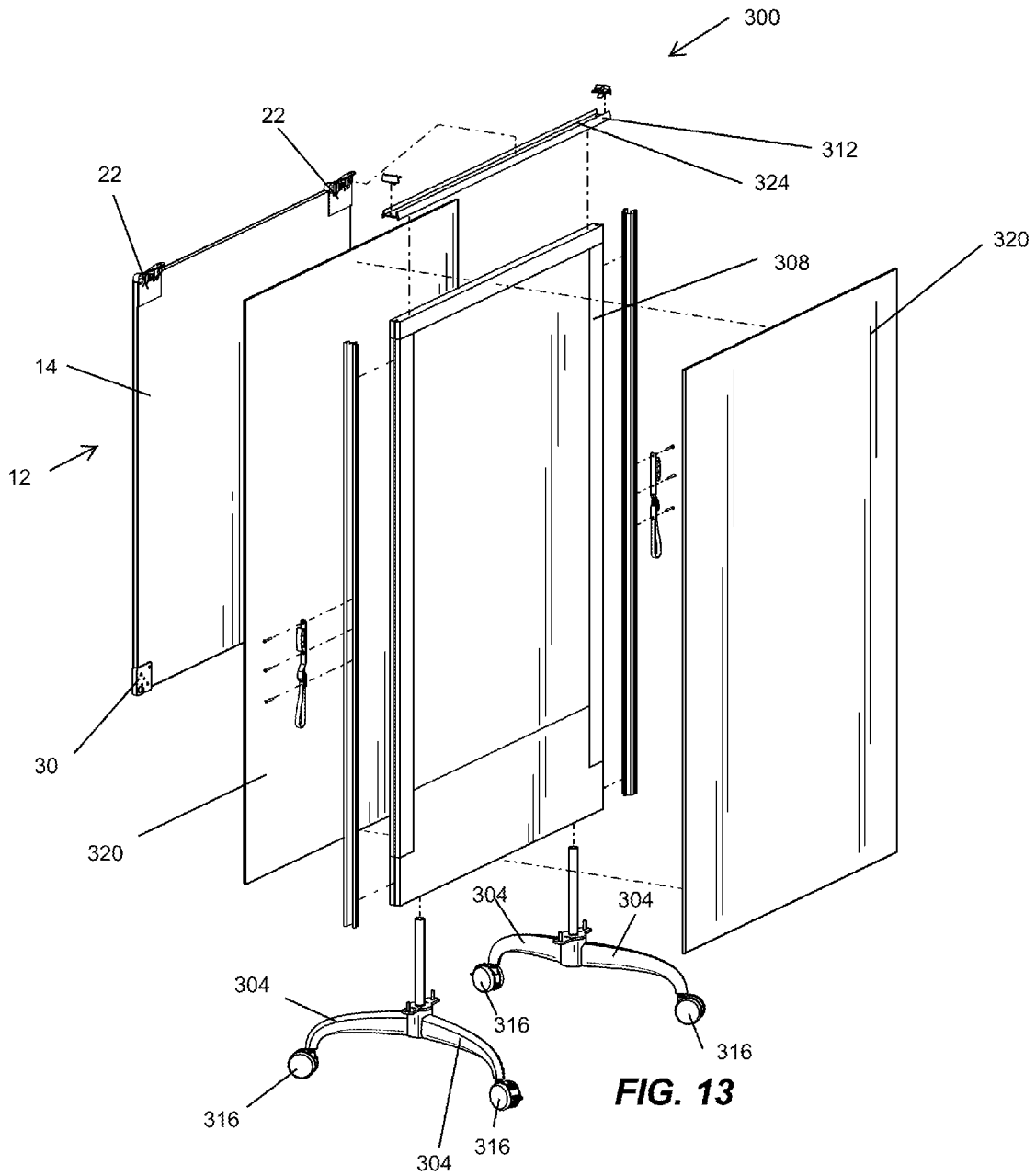
FIG. 13 is an exploded perspective view of the first display board system and the cart of FIG. 12.

FIGS. 12 and 13 illustrate the second cart 300 configured to support one or more display board assemblies 12 (only one display board assembly 12 is shown in the drawings). The second cart 300 is generally larger (e.g., wider) than the first cart 200 to support larger display board assemblies. The second cart 300 includes two leg assemblies 304, a support structure 308, and a support rail 312. The leg assemblies 304 are spaced apart from each other on opposite ends of the support structure 308. Each leg assembly 304 includes two caster wheels 316. The support structure 308 is coupled to and supported by the leg assemblies 304. The support structure 308 includes center panels 320. The illustrated center panels 320 are generally the same size (e.g., width) as the display board assembly 12 and extend all the way down to the leg assemblies 304. The support rail 312 is coupled to an upper edge of the center panels 320. Similar to the support rail 38 described above, the illustrated support rail 312 includes an upwardly extending channel 324 that receives the tabs 110 of the clips 22 to support the display board assemblies 12 on the cart 300. The cart 300 can, therefore, be used to movably support a single display board assembly 12 of a plurality of stacked display board assemblies 12.

As should be readily apparent, two display board assemblies 12 may be hung from the support rail 212, 312 of either cart 200, 300 simultaneously so that one display board 12 is positioned on each side of the cart 200, 300. In some constructions, one or more support rails 38 may be arranged on one or both sides of the carts 200, 300, rather than on the upper edges of the support structures 208, 308. In one construction, a single rail support rail may be provided on the first cart 200 or the second cart 300. In an alternate construction, a pair of back-to-back support rails may be provided on the first cart 200 or the second cart 300. In an alternate construction, two vertically spaced support rails may be provided on the first cart 200 or the second cart 300. In another alternate construction, two back-to-back pairs of vertically spaced support rails may be provided on the first cart 200 or the second cart 300.

The plurality of display board assemblies may be also stacked on the first cart 200 or the second cart 300 for ease of transportation. This allows the plurality of display board assemblies 12 to be stored or transported in a self-supporting stacked configuration.

Thus, the invention provides, among other things, a display board system with stackable display board assemblies. Various features and advantages of the invention are set forth in the following claims.

What is claimed is:

1. A display board system comprising:

a first display board having a front, a back, an upper edge, and a lower edge;

a second display board having a front, a back, an upper edge, and a lower edge;

a first clip coupled to the first display board proximate the upper edge, the first clip including a body extending along a section of the back of the first display board and a top portion coupled to the body generally above the upper edge of the first display board, the top portion having an upwardly facing cavity and a downwardly extending tab, the cavity being closer than the tab to the front of the first display board; and a second clip coupled to the second display board proximate the upper edge, the second clip including a body extending along a section of the back of the second display board and a top portion coupled to the body generally above the upper edge of the second display board, the top portion having an upwardly facing cavity and a downwardly extending tab, the cavity being closer than the tab to the front of the second display board;

wherein the tab of the second clip is receivable in the cavity of the first clip to support the second display board on the first display board.

2. The display board system of claim 1, further comprising a support rail having an upwardly opening channel, wherein the tab of the first clip is receivable in the upwardly opening channel of the support rail to support the first display board on the support rail.

3. The display board system of claim 1, wherein the cavity of the first clip and the cavity of the second clip each forms a depression in the corresponding top portion.

4. The display board system of claim 1, wherein the top portion of the first clip and the top portion of the second clip each includes a sloped upper surface surrounding the corresponding cavity.

5. The display board system of claim 1, wherein the second clip further includes a rib formed on the body and the top portion, and wherein the rib extends outwardly from the second clip and engages the first display board to maintain spacing between the first display board and the second display board.

6. The display board system of claim 1, wherein the cavity of the first clip is generally aligned with the upper edge of the first display board between the front and the back of the first display board, and wherein the cavity of the second clip is generally aligned with the upper edge of the second display board between the front and the back of the second display board.

7. The display board system of claim 6, wherein the tab of the first clip is spaced further than the body of the first clip from the back of the first display board, and wherein the tab of the second clip is spaced further than the body of the second clip from the back of the second display board.

8. The display board system of claim 1, further comprising a spacer coupled to the back of the second display board proximate the lower edge, wherein the spacer includes a boss extending toward the first display board to maintain spacing between the first display board and the second display board.

9. The display board system of claim 8, wherein the spacer includes a sidewall that wraps around a portion of the lower edge of the second display board and a portion of a side edge of the second display board.

10. A clip for a display board having a front, a back, an upper edge, and a lower edge, the clip comprising:

a body configured to extend along a section of the back of the display board, the body being a generally planar member defining a central plane; and a top portion coupled to body and configured to be positioned generally above the upper edge of the display board, the top portion having an upwardly facing cavity and a downwardly extending tab, the cavity being located on one side of the central plane so that the cavity is configured to be aligned with the upper edge of the display board generally between the front and the back of the display board, and the tab being located on an opposite side of the central plane so that the tab is configured to be spaced further than the body from the back of the display board.

11. The clip of claim 10, wherein the cavity has a first cross-sectional shape when viewed in a direction along the central plane, wherein the tab has a second cross-sectional shape when viewed in the direction along the central plane, and wherein the second cross-sectional shape is sized to fit within the first cross-sectional shape.

12. The clip of claim 10, wherein the top portion proximate the cavity has a substantially flat bottom surface that is generally perpendicular to the body.

13. The clip of claim 10, wherein the top portion includes a sloped upper surface surrounding the cavity.

14. The clip of claim 13, wherein the sloped upper surface of the top portion is concave.

15. The clip of claim 10, further comprising a rib formed on the body and the top portion, and wherein the rib extends outwardly from the body and downwardly from the top portion proximate the tab.

16. The clip of claim 10, further comprising a cover coupled to the top portion to substantially cover an upwardly facing surface of the top portion, wherein the cover includes an aperture aligned with cavity.

17. The clip of claim 16, wherein the cover is overmolded on the top portion.

18. A display board system comprising:

a display board having a front, a back, an upper edge, and a lower edge;

a clip coupled to the display board proximate the upper edge, the clip including a body extending along a section of the back and a top portion coupled to the body generally above the upper edge of the display board, the top portion having an upwardly facing cavity and a downwardly extending tab, the cavity being closer than the tab to the front of the display board; and a support rail having an upwardly extending channel, the upwardly extending channel receiving the tab of the clip to support the display board on the rail.

19. The display board system of claim 18, wherein the display board is movable along a length of the support rail while supported by the rail.

20. The display board system of claim 18, wherein the support rail is configured to be attached to a wall or to a cart.

* * * * *